US005324173A

United States Patent [19]

Wick, Sr.

[11] Patent Number: 5,324,173

[45] Date of Patent: Jun. 28, 1994

[54] HIGH PRESSURE INTENSIFIER

[76] Inventor: John R. Wick, Sr., 574 Cedar Hollow Dr., Yardley, Pa. 19067

[21] Appl. No.: 14,110

[22] Filed: Feb. 5, 1993

[51] Int. Cl.[5] ..... F04B 17/00

[52] U.S. Cl. ..... 417/225; 417/201; 60/419

[58] Field of Search ..... 60/419; 417/225, 226, 417/227, 334, 201, 202, 375

[56] References Cited

U.S. PATENT DOCUMENTS 3,952,516 4/1976 Lapp ..... 60/477
4,366,673 1/1983 Lapp ..... 60/477

FOREIGN PATENT DOCUMENTS 2607194 5/1988 France ..... 417/225
120919 2/1948 Switzerland ..... 417/225
692838 6/1993 United Kingdom ..... 60/419

*Primary Examiner*—Richard A. Bertsch
*Assistant Examiner*—Alfred Basichas

[57] ABSTRACT

A hydraulic pressure amplifier has a hydraulic motor for driving a single cam and follower in a piston chamber. A number of conduits and chambers with automatically actuated valves controlling the flow between them are provided, such that, in operation, low pressure fluid introduced into the device to drive the motor will be automatically increased in pressure for discharge-.

8 Claims, 6 Drawing Sheets

HIGH PRESSURE INTENSIFIER

TECHNICAL FIELD

The present invention relates to devices for increasing the pressure of the fluid being supplied to portable hand tools, and in particular to a pressure amplification device for use between a source of low pressure fluid and a high pressure actuated hand tool.

BACKGROUND ART

In the prior art as disclosed, for example, in U.S. Pat. Nos. 3,952,516 and 4,366,673 issued to Ellisworth W. Lapp, there is shown a portable manually operatable pressure amplification device for increasing the pressure from a low pressure source, such as that found on a utility truck, to a hand-held, ,high pressure actuated tool, such as a crimping tool used by a utility lineman. In such devices, it is known to have supply and return low pressure lines, as well as high pressure lines to the tool. The pressure in such devices is controlled by an adjustable pressure relief valve. The devices shown in these patents use a complicated arrangement which includes a high pressure axial plunger pump with a cam and a multiplicity of actuating arms in a plurality of holes; as well as a rotary scavenging pump to aid in removing the oil when the plunger of the crimping tool is on the return stroke. There is also a four-way valve to control the flow of fluid from the high pressure device to and from the tool.

SUMMARY OF THE INVENTION

By the present invention I greatly simplify and make more efficient a pressure amplification device for use, in particular, in connection with hand held high pressure actuated tools. In accordance with my invention, I use a single rotary pump to operate a single cam, and, through the use of appropriately sized and positioned conduits and automatic valves, provide a means to simply and efficiently increase pressure from a low pressure source to a high pressure actuated tool.

DESCRIPTION OF THE PREFERRED EMBODIMENTS

Figure 1:
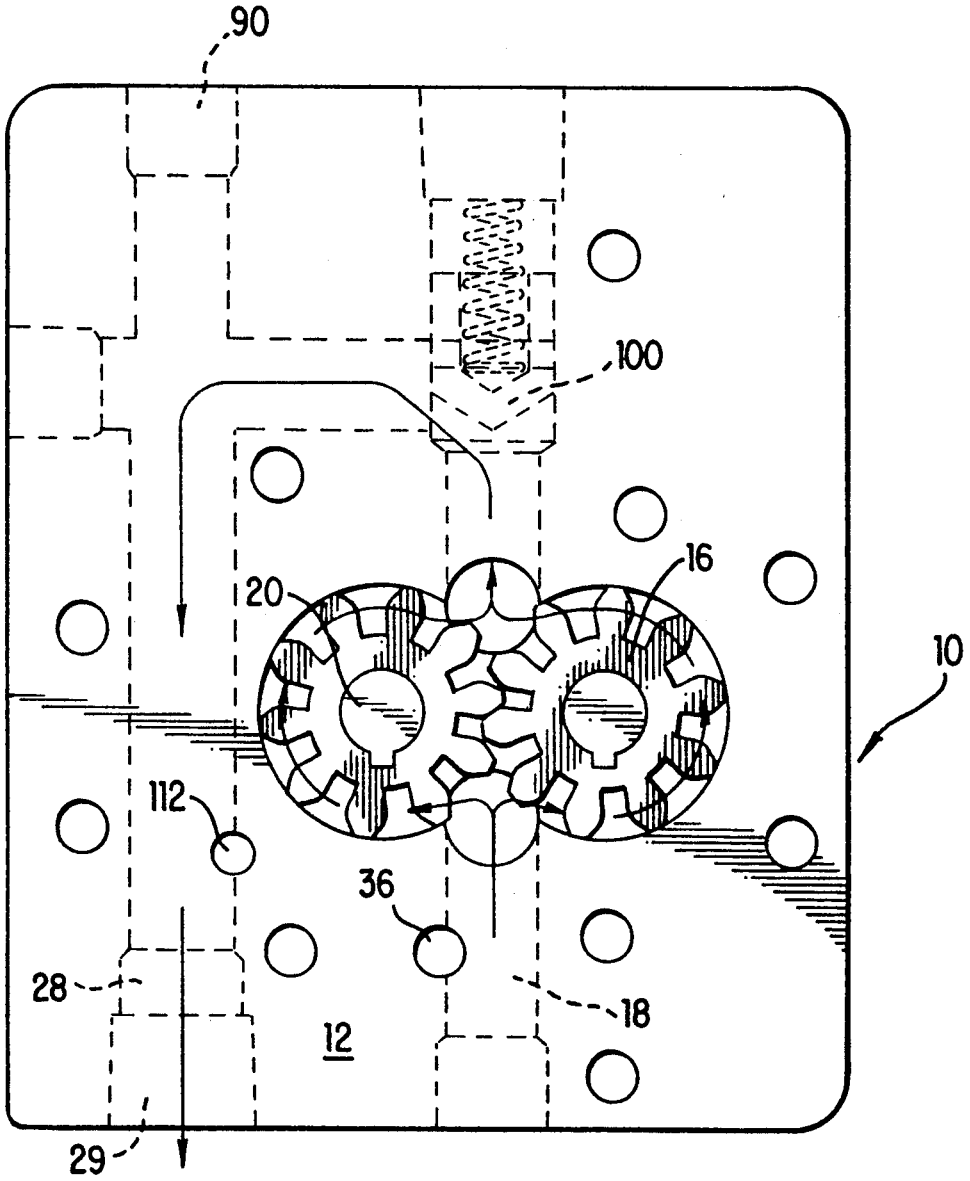
FIG. 1 shows a plan view, partially schematic of one-part, of my device comprising a low pressure block.
Figure 2:
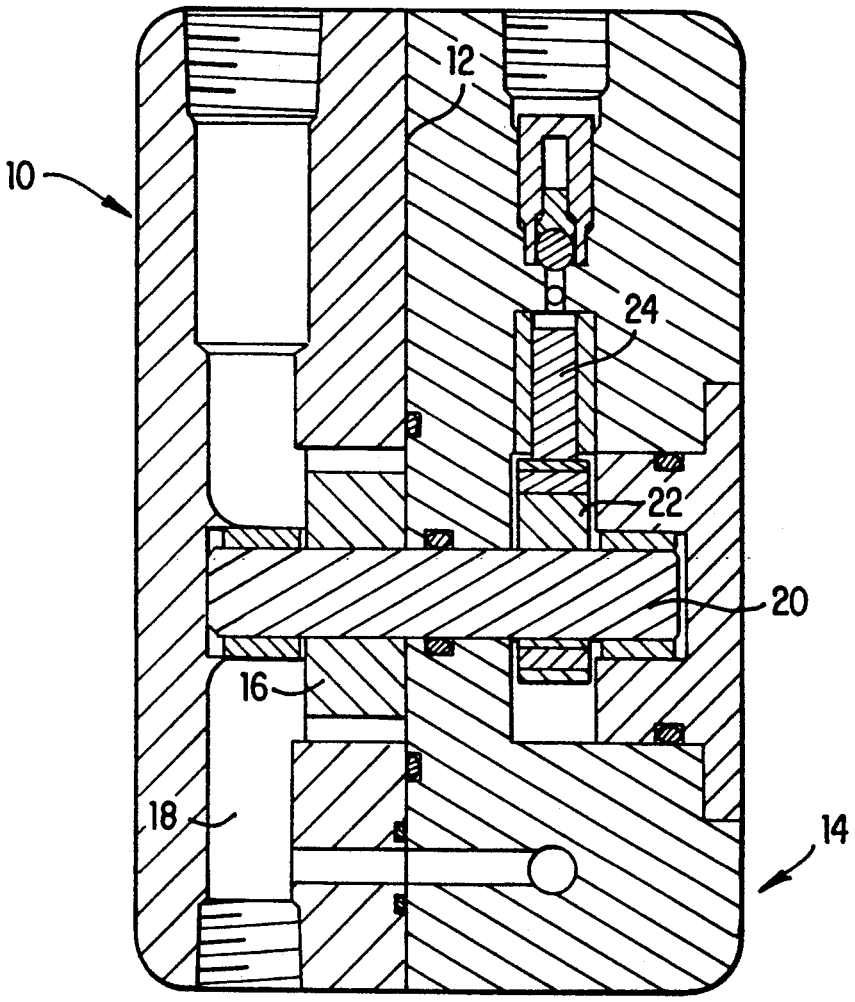
FIG. 2 is a side view, partially schematic and partially in section, showing my device with the low pressure block FIG. 1 shown on the left and the remainder of the device comprising a high pressure block shown on the right.
Figure 3:
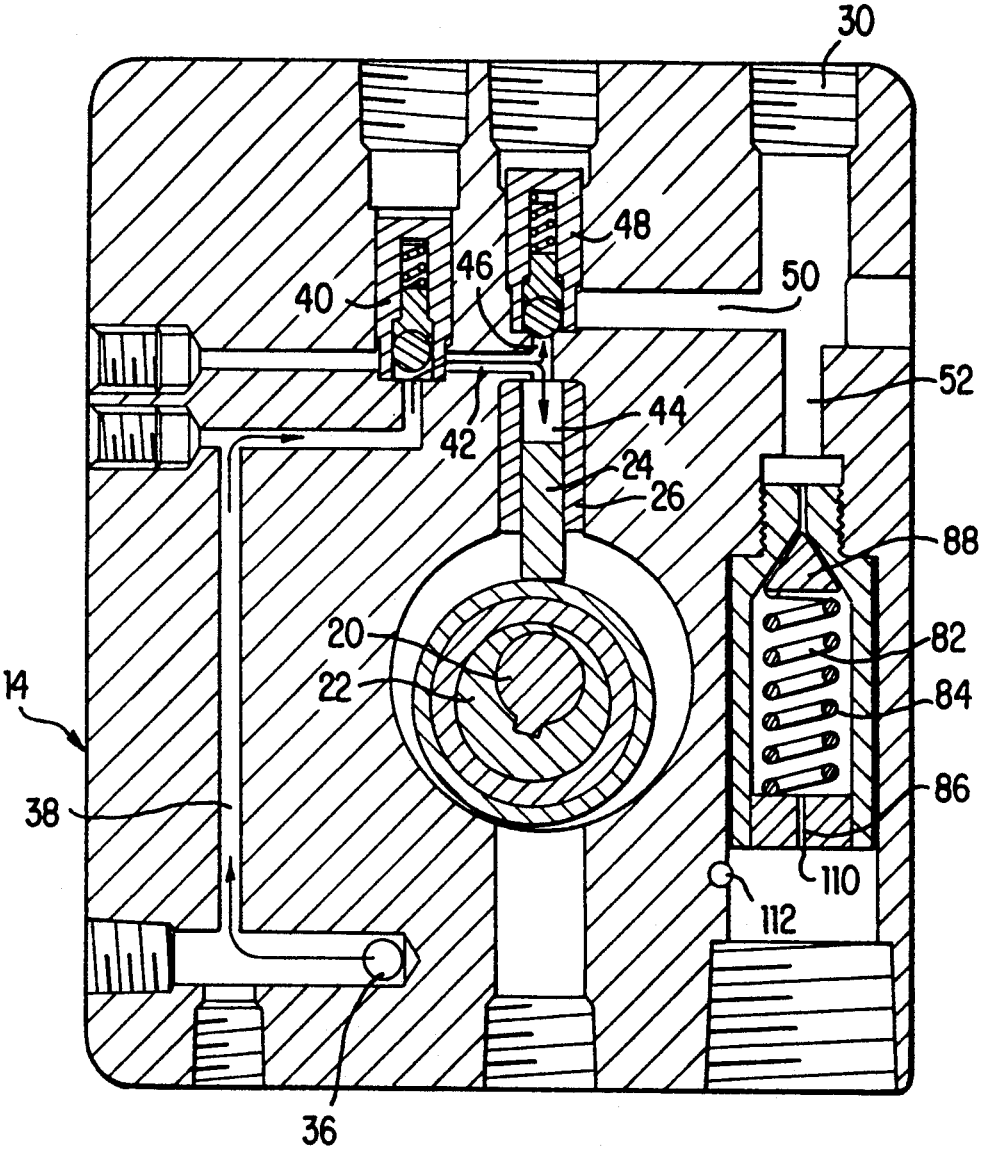
FIG. 3 shows a plan view, partially schematic and partially in section, of the high pressure block.

Referring to the Figures, FIG. 1 shows the low pressure block designated generally 10 which has a flat face of 12 for mating with the flat face of a high pressure block (shown in section) designated generally 14, FIG. 3. The low pressure block has mounted therein by suitable means (not described in detail) a rotary pump, designated generally 16.

Conduit means , generally designated 18, are used to connect the input of the pump 16 to a source of low pressure fluid (not shown) as would commonly be found on a utility truck. This low pressure fluid drives the rotary hydraulic pump 16. The shaft 20 of the pump passes through bearings and is journaled in both the low pressure and high pressure blocks and is connected to a cam 22 FIG. 4 in such a manner as to rotate the cam upon rotation of the hydraulic motor. The cam, in turn, drives a follower 24 mounted in siding engagement within a cylinder 26.

Fluid entering the low pressure conduit means 18 passes through the rotary driven hydraulic motor and exits through conduit means designated generally 28 FIG. 1 which includes the return line to the reservoir source of fluid or sump on the truck.

When high pressure is generated (as will be described more fully herein after), the fluid exits through the port 30 FIG. 4. To get to the tool, shown schematically and designated 32, the high pressure fluid passes through a four-way valve, shown schematically and designated 34, both of which are known in the art.

I will now describe the manner in which the pressure of the fluid is amplified from a low pressure to a higher pressure in this device. I have provided a series of passage means and valve means, comprising a bleed port designated generally 36 FIG. 1 in the low pressure block which communicates with the input conduit means 18 and provides a source of fluid communication for low pressure input fluid to a conduit means 38. The conduit means 38 is controlled at one end by a valve means designated generally 40 FIGS. 3 and 4. This is capable of closing off the conduit means 38 and preventing low pressure fluid from advancing into the chamber designated generally 42. The chamber 42 is in fluid flow communication with the chamber designated generally 44 in the cylinder 26 and both are in fluid flow communication with the conduit means 46. Conduit means 46 is controlled at one end by the valve 48, which controls the flow of fluid between conduit means 46 and conduit means designated generally 50. Conduit means 50 communicates with the high pressure port 30 as well as the conduit means designated generally 52 which communicates with the pressure regulator designated generally 82, which comprises an adjustable pressure relief valve.

In operation, low pressure fluid from the truck pump enters the conduit means 18 and begins to turn the rotary hydraulic pump, which in turn turns the cam 22 and drives the follower 24. Simultaneously, low pressure fluid passes through the input port 36 and then through the conduit means 38 past the valve 40 into the chamber 42, through the conduit means 46, past the valve 48 and into the conduit means 50 and 52. Low pressure fluid also enters chamber 44 of the hydraulic cylinder 26. As the cam drives the follower 24 from the position shown in FIG. 3 to that shown in FIG. 4, reducing the size of the chamber 44, the pressure is increased. When the pressure is equalized, the spring 62 of the valve 40 drives the plunger 66 of that valve and begins to force the ball 60 downwardly to close off the conduit means 38. Increased pressure in the chamber 42 from the advancement of the follower 24 in the chamber 44 of the cylinder 26 causes the ball 60 to completely close off the low pressure conduit means 38.

Now, pressure continues to build, opening the valve 48 even against the back pressure provided by the tool.

As previously stated, the amount of pressure is controlled by the pressure relief valve 82, as for example, by adjusting the spring 84 by means of the slotted threaded adjusting nut 86 and thereby applying pressure against the valve member 88 against the seat of the valve as clearly illustrated in FIG. 3.

Figure 4:
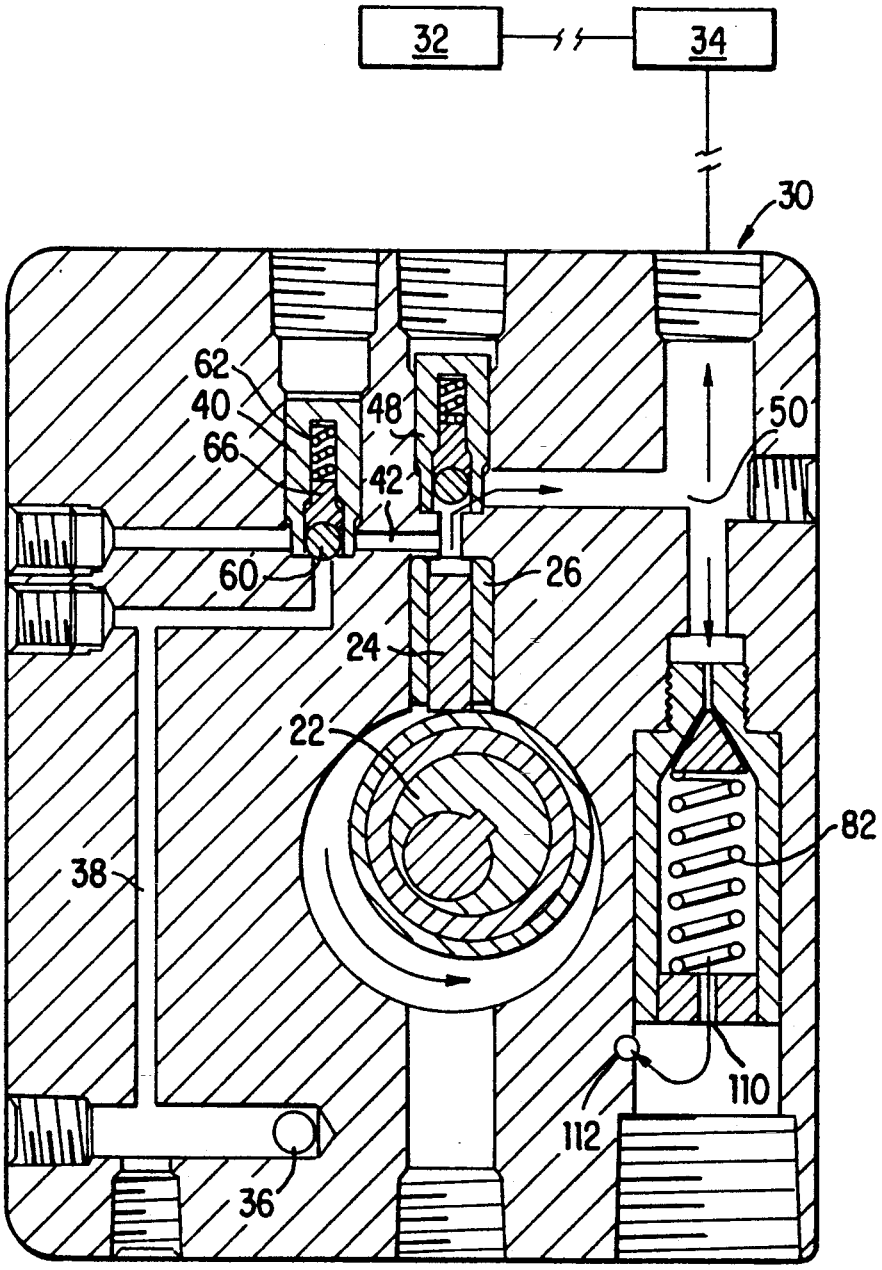
FIG. 4 shows the high pressure block as in FIG. 3, with parts in an alternate position.

As the cam 22 continues to rotate, the follower 24 retracts in the cylinder 26 from the position shown in FIG. 4 to the position shown in FIG. 3. This creates enough of a suction draw or vacuum pressure to allow the valve 48 to close off the conduit means 46 and prevent fluid flow communication from that conduit to the conduit means 50.

With the valve 48 closed, and the follower 24 fully retracted, low pressure begins to fill the chamber; and then the cycle repeats itself.

Figure 6:
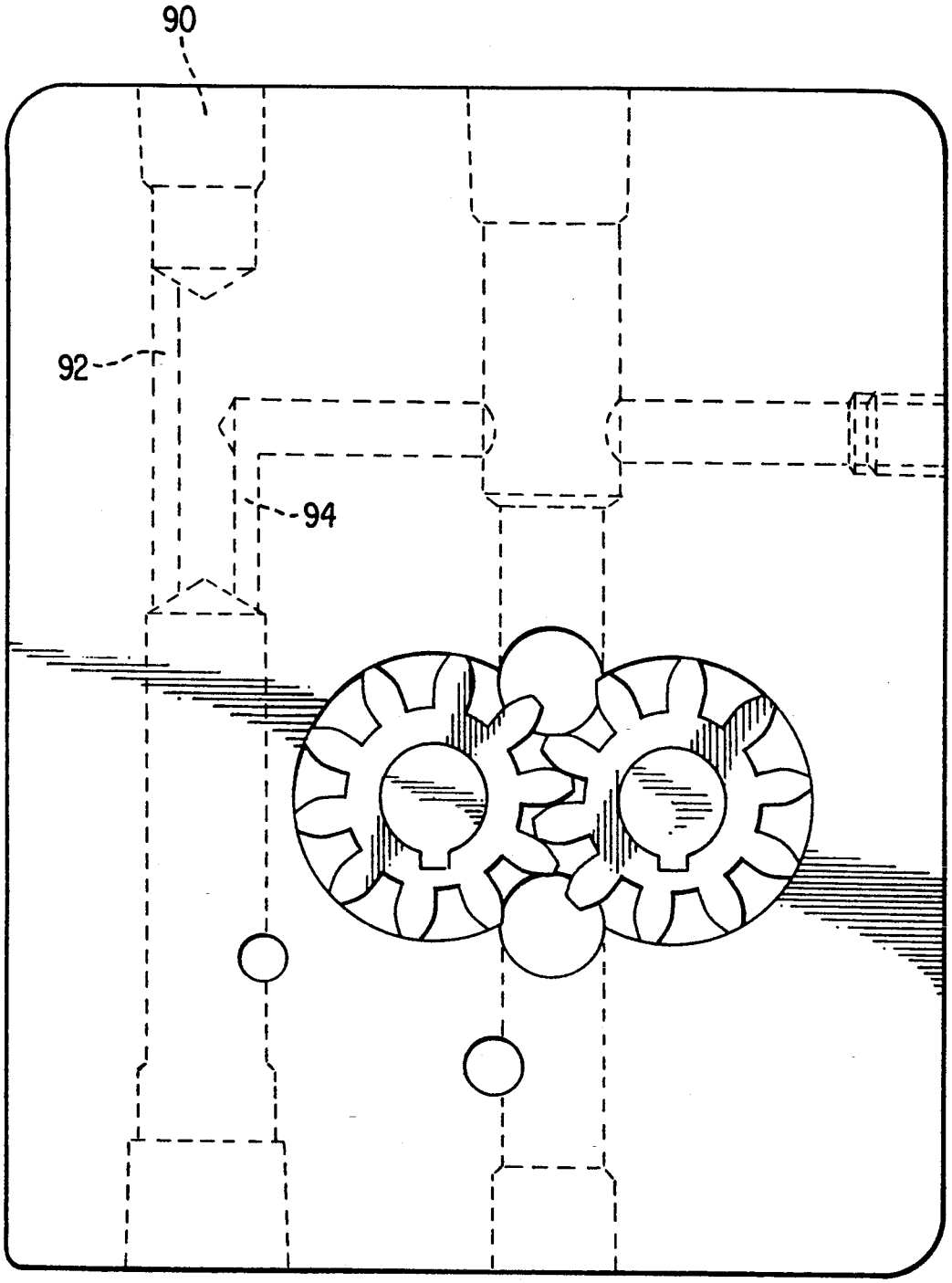
FIG. 6 shows an enlarged plan view of an alternate embodiment of my invention with a preferred arrangement of conduits.

I will now describe in detail some of the parts and parameters which are most preferred in this device. First I note that since the device is connected to a four-way valve there is a port designate generally 90 FIG. 1 which is used for a return line form the four-way valve and which is in fluid flow communication with the conduit means 28 to return the low pressure fluid to the sump. In the embodiment shown in FIG. 6, a portion of this return line, designated generally 92 is most preferably of a narrower diameter than the remaining portion of the conduit means 28. Also, a second portion, designated generally 94 is of a narrower cross sectional area than the remaining portion of the conduit 28. This creates a venturi-like effect, such that an increased velocity pulls the low pressure oil from the conduit 92. This overcomes a problem in a four-way valve as it keeps it from exerting a forward force on the tool. Normally in a four-way valve, on a return stroke of the tool, the oil in the return line actually splashes out.

A check valve may be inserted at 100, FIG. 1, to prevent a reverse circuit through the hydraulic motor if one tried to make the connection through the return line port 29.

As to the preferred details, the cam is encased in a needle bearing and a hardened steel sleeve to reduce friction. Additionally, the cam shaft and idler shaft are running in needle bearings to further eliminate friction. The two blocks, high pressure and low pressure, and the cam shaft are sealed from leaks and to retain the low pressure fluid by the use of "O" rings.

The tool requires a predetermined pressure of ten thousand psi, for example, to complete its proper function. This feature is attained through the use of the pressure relief valve previously described. In operation, at ten thousand psi, the pressure would overcome the force of the spring 84 in the pressure relief valve causing the valve member 88 to leave the valve seat. The fluid will pass through the valve body and exit through the port 110 and then through the port and conduit means 112 to the return line and back to the reservoir. The pressure relief valve is designed to release very quickly, causing a sudden drop in pressure; thereby alerting the operator that the unit has attained its proper sequence of operation. This feature is extremely helpful in the environment in which the operator is working. Many times it is the only way the operator would know that a crimp has been completed, such as in situations in which crimping splices overhead are being completed under conditions in which the operator can't see the work.

Incoming fluid is generally between twelve hundred and twenty-five hundred psi at an average of five gallons per minute. However, there are times when the pump delivery is reduced to as low as three and one half gallons per minute. It is the gallons per minute more than the psi that is a factor that will govern the efficiency of the amplifier. This should be taken into account in designing the amplifier to function in this environment.

In order to accomplish this, certain features have to be very carefully designed particularly as to the size and configuration. While dimensions are not limitations, I will describe these dimensions of parts that I have used. I will also describe the location and configurations. In FIG. 1, for example, the inlet conduit means is below the level of the hydraulic motor. The channel is then swept upward smoothly in order to enter the motor chamber in a most advantageous fashion; distributing the fluid to the motor cavity evenly. The same principle holds regarding the exit side and exit port. The fluid must leave the motor cavity in such a way, that it does not create back pressure and diminish the efficiency of the motor. I have determined that it is most preferred to direct the fluid so that it is not directed against the adjoining teeth in the center of the motor. If it was, oil would created back pressure on the teeth. By having the fluid connections so that the oil comes in from the side, it greatly improves the efficiency of the motor.

In a specific embodiment, in order to keep the low pressure check valve from being overridden, the low pressure conduit could be no larger than three-thirty-seconds in diameter. If larger, the force of the low pressure will hold open the check valves and not allow them to function in the proper sequence.

Figure 5:
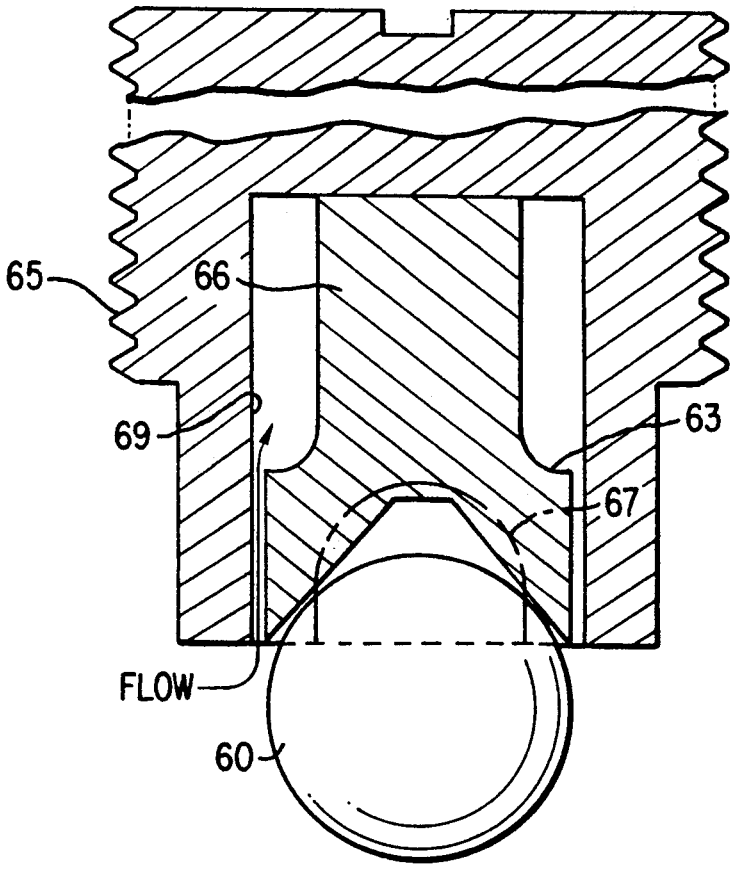
FIG. 5 shows a greatly enlarged detail, partially in section, of a portion of the apparatus comprising a valve.

The check valve balls were three-sixteenth inches in diameter to allow sufficient overlap to properly seat and seal the fluid passages. A particular arrangement of a check valve body, plunger and ball is shown in an enlarged FIG. 5. The check valve body 65 is threaded and has a screw driver slot at one end so that external adjustments can be made to position the plunger 66 and ball The lower portion of the check valve body 65 has a plurality of 60. slots 67 configured as shown in FIG. 5 to allow fluid to enter the body and get behind the ball. Fluid can also pass between the plunger and the cylindrical wall 69 of the check valve body and get behind the plunger 66 to impinge upon the shouldered portion 63 and drive said plunger from said valve body.

The cam follower or piston size and stroke are also critical items. They are governed by the output port furnished by the hydraulic motor. The limitations here are, of course, the fluid pressure and gallons per minute. The amplifier must be defined around those specifications. In this case the cam follower or piston is 0.208 in diameter and the stroke is one quarter inch.

The high pressure duct is designed to be a minimum length and diameter in order to have as small a cubic volume as possible. The piston stroke must overcome the fifteen hundred to twenty-five hundred psi in the chamber and recharge to high pressure before pumping through the high pressure check valve and into the high pressure conduit.

The length of the chamber 42 should be as short and small as possible in order that the piston doesn't have to overcome a larger area, particularly at three and a half gallons per minute.

The pressure relief valve, as stated before, is designed to open at a pre-determined pressure and reseat itself after relieving the pressure to zero; so that by holding the attached four-way control valve 34 (not shown in detail, but known in the art), in a forward stroke position, the relief valve will cycle continuously pumping to pressure and relieving.

I claim:

1. A hydraulic pressure amplifier, comprising:

a. first conduit means having a port for connection to a source of low pressure fluid;

b. a fluid actuated motor in fluid flow communication with said first conduit means to receive low pressure fluid therefrom to drive said motor;

c. a cam connected to said motor to be driven thereby;

d. a follower engaging said cam should be moved upon movement of said cam; said cam being mounted in a cylinder;

e. second conduit means in fluid flow communication with said first conduit means to receive low pressure fluid therefrom;

f. a first chamber in fluid flow communication with said second conduit means to receive fluid therefrom;

g. valve means positioned between said second conduit means and said first chamber to control the flow of fluid between said second conduit means and said first chamber;

h. second chamber means formed by said cylinder and said follower, in fluid flow communication with said first chamber;

i. third conduit means in fluid flow communication with said chambers;

j. fourth conduit means in fluid flow communication with said third conduit means; said fourth conduit means terminating in an outlet port;

k. second valve means between said third conduit means and said fourth conduit means to control the flow of fluid therebetween;

l. an adjustable pressure regulator means;

m. fifth conduit means in fluid flow communication with said fourth conduit means and said adjustable pressure regulator to pass fluid therebetween;

n. all of said means functioning such that when low pressure fluid is introduced into said device, said low pressure fluid drives said motor and said cam and follower to increase the pressure in said fluid exiting from said fourth conduit means through said port.

2. The invention of claim 1, which said valve means are automatically responsive to fluid flow and movement of said follower.

3. The invention of claim 1, wherein the adjustable pressure regulator is an adjustable pressure relief valve having a second port exiting therefrom remote from the fluid flow communication of said relief valve with said fifth conduit means; and a. a sixth conduit means is in fluid flow communication with said second port in said pressure relief valve to receive fluid therefrom and transport said fluid to a seventh conduit means;

b. said seventh conduit means terminating in a third port for discharging excess fluid from said device.

4. The invention of claim 3 wherein said pump has a discharge and wherein said seventh conduit means is in fluid flow communication with the discharge of said pump.

5. The invention of claim 4 wherein the seventh conduit means has a first portion thereof terminating in a fourth port, a second portion thereof in fluid flow communication with said fourth port so as to discharge thereinto at a first point, said fourth port being adapted to be connected to a source of fluid external of said device; said second portion being of a smaller diameter than the diameter of the first portion thereof; and wherein a third portion of said seventh conduit means which is in fluid flow communication with the discharge of said pump is of a smaller diameter than said first portion and forms a passage discharging into said first portion at a second point adjacent to said first point at which said second portion discharges into said first portion, whereby fluid being discharged from said pump passing through said smaller diameter third portion accelerates and is discharged into the first portion of said seventh conduit means thereby drawing fluid through said narrow diametered second portion of said seventh conduit means.

6. The invention of claim 1 wherein each of said valve means comprises:

a. a valve body adjustably positioned within said device;

b. a plunger within said valve body; and c. a ball engaged by said plunger to seat against said the conduit means.

7. The invention of claim 6 wherein said valve body has a plurality of slots, permitting fluid flow communication to a portion of said ball within said valve body, when said ball is engaged by said plunger and positioned, at least partially, within said valve body.

8. The invention of claim 6 wherein said plunger is so dimensioned with respect to said valve body that there is a space therebetween permitting the flow of fluid therebetween and said plunger is configured to have a shouldered portion whereby fluid may impinge thereon and drive said plunger from said valve body.

* * * * *